United States Patent [19]

Matthews

[11] 4,103,571

[45] Aug. 1, 1978

[54] HUB NUT WRENCH

[75] Inventor: Robert L. Matthews, Baton Rouge, La.

[73] Assignee: M & M Tools, Inc., Baton Rouge, La.

[21] Appl. No.: 807,814

[22] Filed: Jun. 20, 1977

Related U.S. Application Data

[63] Continuation of Ser. No. 664,948, Mar. 8, 1976, abandoned.

[51] Int. Cl.[2] ..... B25B 13/48

[52] U.S. Cl. ..... 81/74

[58] Field of Search ..... 81/53 R, 74, 76, 177 E

[56] References Cited

U.S. PATENT DOCUMENTS

| | | | |
|---|---|---|---|
| 3,295,399 | 1/1967 | Juneau | 81/74 |
| 3,742,790 | 7/1973 | Galley | 81/177 E |

*Primary Examiner*—James L. Jones, Jr.
*Assistant Examiner*—James G. Smith
*Attorney, Agent, or Firm*—Arthur M. Dula; Russell D. Weaver

[57] ABSTRACT

The present invention is a tool used to demount polygonal hub nuts from a threaded axle located within a wheel hub. The tool comprises at least two steel bars slidably and rotatably joined by a buckle pivot. Each end of each bar is equipped with a rounded raised surface. The four rounded raised surfaces are dimensioned so the nut engaging end of the tool will fit snugly between one face of the hub nut and the wheel hub. The cross-member on the tool is rotated so lugs on the wheel hub strike a lug protection plate mounted on the cross-member. The tool transfers torque imparted to it by the lug to the hub nut. When not in use, the tool may be collapsed for ease of storage.

12 Claims, 4 Drawing Figures

HUB NUT WRENCH

This is a continuation of application Ser. No. 664,948, filed on Mar. 8, 1976, now abandoned.

BACKGROUND OF THE PRESENT INVENTION

1. Field of the Invention

The present invention pertains generally to wrenches used to unfasten polygonal nuts recessed into an axle hub and more specifically relates to such a wrench that engages only one facet of said polygonal axle nut and is actuated by rotation of an associated wheel.

2. Background of the Prior Art

It is old in the art to completely encase a polygonal nut in a thin wall socket and apply torque to the center of the socket to remove the nut. Sockets of this type break easily because of their thin wall construction. Further, a large number of varying size sockets must be bought and stored to accomodate the different sizes of nuts used on commercial vehicles.

Wrenches constructed according to the general concept of the present invention are also well-known. U.S. Pat. No. 2,512,978 teaches such a wrench as does U.S. Pat. No. 3,295,399, which is incorporated herein by reference. All wrenches taught by the prior art suffer from disadvantages. Prior art wrenches can accomodate only specific sizes of nuts and will operate properly only if the nut is at a particular distance within a wheel hub. Additionally, prior art wrench designs teach that the slidably disposed member must be locked in rigid orthogonal alignment with its cross-member to operate properly. Such wrenches are extremely difficult to store or carry conveniently and are very heavy. Further, this orthogonal fixed alignment will not allow the wrench to adapt to all types of hubs. For practical reasons no prior art wrench of the type taught by the present invention has achieved commercial success.

In addition to structural deficiencies of present and all prior art wrenches, no prior art wrench could function without ruining the associated hub's wheel lugs. This type of wrench must be made of tool steel to be tough enough to remove a tightly screwed on nut without ruining or deforming. Tool steel is much harder than mild steel used to make threaded lugs such as the lugs that strike the wrench. In normal operation, threaded lugs impinge upon the upper surface of one arm of the wrench with considerable force. This force does not harm the tool, but does deform threads on the lug. This ruins the lug. It will readily be appreciated that this practical drawback prevents prior art wrenches from achieving commercial success.

It is an object of the present invention to provide a tool that is lighter and simpler than prior designs while retaining all their advantages.

It is a further purpose of the present invention to provide a tool whose longitudinal members are slidably and rotatably affixed to one another so the tool may be collapsed for storage and adapt to all hub designs.

Yet still another purpose of the present invention is to provide a tool that operates without ruining threads on the striking lug used to actuate the tool.

Yet still a further purpose of the present invention is to provide a tool capable of demounting a large number of different sizes of hub nuts regardless of their disposition within the hub.

SUMMARY OF THE PRESENT INVENTION

The present invention comprises at least two elongated members slidably and rotatably mounted in a connector block, each end of each tool having a nut engaging portion.

The nut engaging portion has a flat lateral face parallel to the longitudinal axis of the elongated member and an outwardly curved surface opposite the flat lateral face. The curved surface has an axis of curvature substantially parallel to the longitudinal axis of its respective longitudinal member.

The connecting block comprises two half buckle shaped restraining members each adapted to contain an elongated member and rotatably joined by a pivot pin. Said elongated members are slotted to allow them to rotate and slide to a plurality of positions.

To use the tool, a nut engaging portion of one elongated member is inserted within a wheel hub so its curved surface contacts the inner surface of the hub and its flat surface lies adjacent to the side of the polygonal axle nut. The other elongated member is then rotatably and slidably adjusted to encounter the studs which project from the end of the hub. The stud pad, which is a mild steel pad covered with a resilient material, is locked into position beneath the stud and the wheel is rotated causing the tool to remove the nut.

The stud pad is provided with a threaded shank to hold it in position. When the tool is not in use, the elongated members are rotated on top of one another for storage and the threaded shank of the stud pad inserted through both slots and locked into position by a nut.

DESCRIPTION OF THE PREFERRED EMBODIMENT

Figure 1:
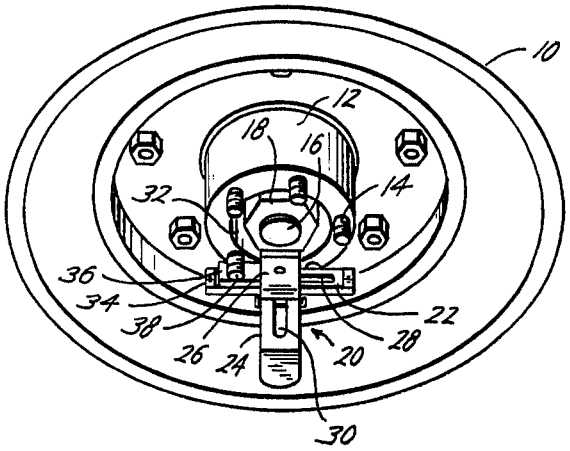
FIG. 1 shows an operational isometric view of a wrench constructed according to the preferred embodiment of the present invention.

FIG. 1 illustrates the preferred embodiment of the present invention in its operative position with the nut engaging portion inside the wheel hub.

Wrenches taught by the present invention are well adapted to remove hub nuts from full or semi-floating axles. In FIG. 1 it will be observed that the hub cap has been removed from wheel 10 and the inner floating rear axle has been withdrawn from the axle housing.

Wheel 10 has axle housing 12 from which project a plurality of threaded studs 14. Within axle housing 12 the end of axle 16 threadably engages nut 18. Nut 18 is a hexagonal axle nut. Tool 20 is shown with cross-bar 22 set at right angles to cross-bar 24. Rotatable buckle 26 connects the two cross-bars through slots 28 and 30.

The wrench is illustrated with its forward nut engaging portion occupying annular space 32 between the inner surface of housing 12 and the outer surface of the bottom facet of nut 18.

To remove nut 18 from axle 16, it is necessary to rotate the nut counterclockwise. The left hand side 34 of cross-bar 22 carries a rubber surfaced pad 36, which will be described in detail below. Pad 36 is positioned on arm 34 so threaded stud 38 strikes its surface.

Functionally, to unscrew nut 18 from axle 16, the tool is placed as shown and rim 10 is rotated counterclockwise. This causes hub 12 and associated stud 38 to rotate counterclockwise. Stud 38 strikes rubberized pad 36. This causes tool 20 to rotate nut 18 counterclockwise, which unscrews the nut from the axle.

It will be readily apparent that a reversal of this procedure would allow the nut to be tightened with pad 36 being clamped to the right hand side of arm 22, stud 14 striking the surface of pad 36 while the wheel 10 is rotated clockwise to tighten nut 18. It is also obvious that this tool will adjust to remove and insert nuts lying different distances within a wheel hub. Inserted longitudinal member 24 can slide further into the hub to the limit permitted by slot 30. Likewise, any end of the tool can unfasten a nut. The plurality of different nut engaging portions assures that the present tool will be capable of handling all commonly encountered situations.

Figure 2:
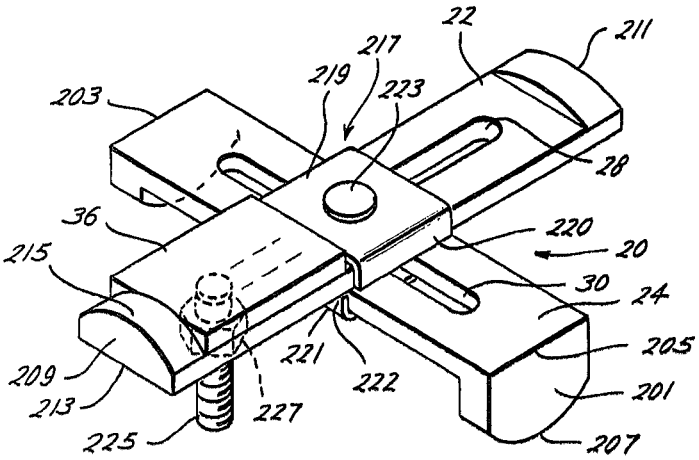
FIG. 2 is a isometric view of a wrench constructed according to the preferred embodiment of the present invention extended for operation.

FIG. 2 shows an isometric view of tool 20 in its operating position. This figure is presented to show details that are not visible in the operational view shown in FIG. 1.

Cross-bar 24 has a first nut engaging end 201 and a second nut engaging end 203 located at its opposite ends. The upper surface 205 of nut engaging end 201 is flat. Lower side 207 of nut engaging end 201 is curved and the axis of curvature of this curve is parallel to the upper surface 205. Likewise, cross-member 22 has a first nut engaging portion 209 and a second nut engaging portion 211 lying at its opposite ends. The lower side 213 of nut engaging portion 209 is flat. The upper portion 215 of nut engaging end 209 is curved. Again the axis of curvature of this curve is parallel to the lower flat portion of the longitudinal member.

Nut engaging ends 201, 203, 211 and 213 differ in the distance from the top of the curved side to the bottom of their respective flat sides. This allows the present invention to fit snugly with the flat side of one of the nut engaging portions proximate a facet of a polygonal nut while the curved side is in close contact with the curved surface of the hub. Thus the tool may be used to remove or insert a large number of different sized nuts and it replaces many different thin-walled sockets for this task. Longitudinal members 24 and 22 are provided with slotted openings 30 and 28 respectively. The slotted openings run down the median of the longitudinal member and are approximately two-thirds of the length of the tool.

Buckle 217 has an upper flanged portion 219, a lower flanged portion 221, which are connected by pivot pin 223. The flanges have curved portions 220 and 222, respectively.

Rubberized pad 36 is shown attached to threaded shank 225 and is held firmly in place by nut 227.

Lower surface 213 of cross-member 22 and upper surface 205 of longitudinal member 24 are both flat. This functionally allows them to slide and rotate over each other to conform the tool to a large number of different operating positions. This ability to rotate also allows the tool to be collapsed for storage, as will be described later.

Nut 227 can be unscrewed from shank 225. This allows rubberized pad 36 to be removed from the tool. When rubberized pad 36 is so removed the longitudinal members 22 and 24 freely rotate about pivot pin 23. Each longitudinal arm can slide right and left or at an angle with respect to the other longitudinal member. The limit of motion imposed on the tool is dictated by the length of slots 28 and 30.

This tool may be made of any material hard enough and tough enough to allow it to perform its function. In the preferred embodiment of the present invention the tool is made of Tl tool steel and slots 28 and 30 are machined out of the stock.

Figure 3:
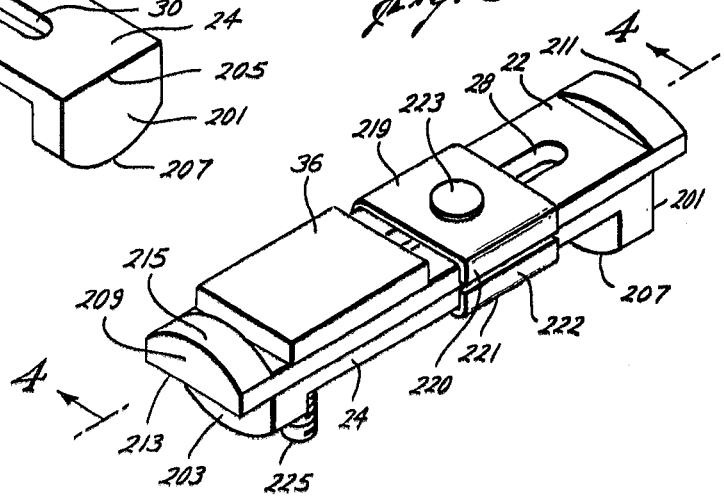
FIG. 3 is an isometric view of the preferred embodiment of the present invention closed for storage.

FIG. 3 shows the tool constructed according to the preferred embodiment of the present invention in its collapsed position.

As compared with FIG. 2, FIG. 3 shows lower longitudinal member 24 rotated approximately 90 degrees about pivot pin 223. It is now parallel with upper longitudinal member 22. Slots 28 and 30 (not shown) are now coincident and stud 225 of rubber pad 36 has been inserted through both of them.

The tool as illustrated in FIG. 3 shows the lower longitudinal member 24 to be slightly shorter than upper longitudinal member 22. This is an arbitrary construction of the preferred embodiment of the present invention. The invention is illustrated in this manner so the physical relationship between the parts may be more easily grasped. Lower member 24 may, in actual operation, be as long as upper member 22.

Functionally, the present invention is capable of assuming this compact shape, which quantitatively occupies less than one-quarter of the volume occupied by the same tool when it is expanded for use. This yields two immediate benefits. First, the tool may now be stored conveniently in a mechanic's tool kit or slipped into the mechanic's pocket. Secondly, because the cross-arm does not have to be at a 90 degree angle to its nut engaging counterpart, the tool can adapt to minor irregularities in hub design and stud length. No prior art tool teaches either of these advantages. Rubberized impact block 36 serves two functions. First, it serves the function described in connection with FIG. 1 above, that of a stud protection pad. In the past studs would strike the tool steel surface of the tool and would be damaged. In the present invention the studs strike the flexible surface of the pad. They impart the same amount of force to the tool, but pad 36 conforms to the structure of the threaded lug and does not damage the threads. Secondly, stud pad 36 serves to hold the tool locked into its compact storage position. This is accomplished by removing nut 227 from shank 225 of stud pad 36 and lifting the stud pad free of the tool. The tool is then rotated into its closed position and stud pad 36's shank 225 is reinserted through both longitudinal slots. Nut 227 is then replaced on the stud.

Figure 4:
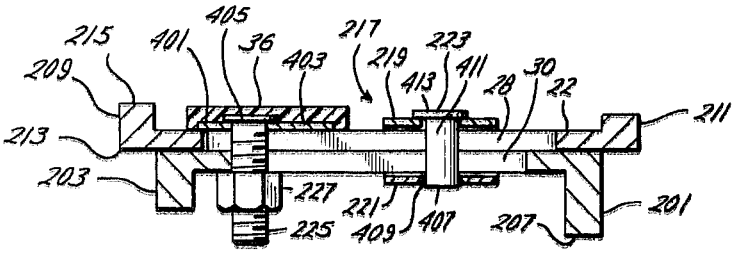
FIG. 4 shows side cross-section view taken along lines 4—4 of FIG. 3.

FIG. 4 shows a cut-away cross-sectional view along lines 4—4 of FIG. 3. This view is included to illustrate details of internal construction of the present invention. As in the other drawings like numbers illustrate like structural features.

Rubberized pad 36 has a rubberized coating 401 overlying a steel plate 403. The upper portion 405 of shank 225 is affixed by brading, welding or any other suitable means to the plate 403. In turn rubber surface 401 is attached by cement or glue or any other suitable means to the upper surface of plate 403.

Buckle 217 has an upper buckle member 219 and a lower buckle member 221. These two members are joined by means of a pivot pin 223. Pivot pin 223 is shown joined at its lower end 407 to buckle 221 by welds 409. Any method of attaching the pivot pin to the upper and lower buckle means that is strong enough to allow the tool to perform its intended function will be sufficient for the present invention. For example, both sides of the pivot pin could be bradded so both the upper and lower portion of the buckle would rotate relative to the pin. Upper portion 411 of pivot pin 223 is shown having a brad 413 which affixes it to and restrains upward motion of upper buckle 219.

Functionally, both the rubber stud pad and the buckle connector have been described in detail in connection with FIGS. 1 and 2 above.

Although the preferred embodiment of the present invention illustrated and described above is believed by the inventor to be the best embodiment of the present invention, it should be obvious that minor mechanical alterations of this tool may be made without departing from the spirit of the invention. For example, it would be possible to coat the entire tool with a resilient plastic material and thus remove the need for one of the uses of the stud pad. Additionally, any tool that operates according to the principle of the present invention, i.e. that can rotate and translate about its longitudinal members, will practice the present invention despite changes in material or length and width of the component elements. Further, the present invention may employ three or more elongated members joined by a common pivot. This is not possible using the fixed, non-rotatable designs taught by the prior art. Therefore, the preferred embodiment of the present invention illustrated above should be understood to be only an example of the present invention. The present invention is limited only by the appended claims and their reasonable equivalents.

I claim:

1. A wrench for removing a polygonal sided nut from a threaded axle located within a wheel hub comprising:

a connector having a central pivot pin;

at least a pair of elongated members each having an axial slot, said members being mounted in said connector such that said elongate members are in intimate contact with one another and such that said elongate members are slidable and rotatable with respect to one another and are slidable with respect to said connector, said pivot pin passing through the slot of each said elongated member; and at least one nut engaging portion at the end of at least one of said slotted elongated members, said nut engaging portion having a flat lateral face parallel to the longitudinal axis of said elongated member, and an outwardly curved surface opposite said lateral face, said curved surface having for its axis of curvature a line substantially parallel to the longitudinal axis of said longitudinal member; whereby said nut engaging portion may be inserted within a wheel hub such that such curved surface contacts the inner surface of the hub and the flat surface is proximate one facet of said axle nut.

2. A wrench as taught by claim 1 wherein said connector is a rotating buckle comprising:

an upper restraining member having curved sides separated by a flat portion that is substantially the width of its associated longitudinal member;

a lower restraining member having curved sides separated by a flat portion approximately as wide as the width of its associated longitudinal member; and a pivot pin rotatably joining said upper and lower restraining members.

3. A wrench as taught by claim 1 wherein each end of each elongated member is equipped with a nut engaging portion each said portion adapted to engage a different size nut.

4. A wrench as taught by claim 1 including an elastic stud protection plate comprising:

a flat plate covered on one side with an elastic material and connected on its other side to a shank, said shank being capable of passing through at least one slot of one of said elongated members and further capable of engaging a nut to securely hold said pad in a fixed position.

5. A wrench as taught by claim 1 including a coating of resilient elastomeric material over a stud contacting portion of at least one of said elongated members.

6. A wrench as taught by claim 1 wherein said pair of elongated members includes a first elongate member and a second elongate member, said first and said second elongate members each having an outer surface, said outer surface of said first elongate member and said outer surface of said second elongate member facing in opposite directions, and said connector is a buckle including a first restraining member and a second restraining member, said first restraining member having a central portion juxtaposed to said outer surface of said first elongate member and having substantially the same width as said outer surface of said first elongate member, said second restraining member having a central portion juxtaposed to said outer surface of said second elongate member and having substantially the same width as said outer surface of said second elongate member, said first and second restraining members being held together by said pivot pin.

7. A wrench as taught by claim 6 wherein said first elongate member is slidable with respect to said first restraining member and said second elongate member is slidable with respect to said second restraining member.

8. A wrench as taught by claim 7 wherein said first restraining member includes side portions on opposite sides of said first restraining member central portion and juxtaposed to the sides of said first elongate member, said second restraining member includes side portions on opposite sides of said second restraining member central portion and juxtaposed to the sides of said second elongate member, and said pivot pin being rotatably attached to said first and said second restraining members.

9. A wrench as taught by claim 1 including means for releasably retaining said elongate members in a position wherein said elongate members are parallel to one another.

10. A wrench as taught by claim 9 wherein said slots of said elongate members are coincident with one another when said elongate members are parallel to one another.

11. A wrench as taught by claim 10 wherein said retaining means includes a threaded shank capable of passing through said slot of each of said elongate members when said elongate members are parallel to one another and a nut threadingly receivable by said shank.

12. A wrench as taught by claim 11 wherein said retaining means includes a flat plate attached to said shank, said flat plate being covered with an elastic material.

* * * * *